United States Patent [19]

Robertson

[11] 4,379,577

[45] Apr. 12, 1983

[54] LATCH BOLT STRIKE LOCK

[76] Inventor: Gene V. Robertson, 1906 Esther Dr., Carlisle, Pa. 17013

[21] Appl. No.: 172,691

[22] Filed: Jul. 28, 1980

[51] Int. Cl.[3] ..... E05C 13/02

[52] U.S. Cl. ..... 292/341.15; 292/170

[58] Field of Search ..... 292/170, 341.15, 341.17, 292/341.18

[56] References Cited

U.S. PATENT DOCUMENTS

| | | | |
|---|---|---|---|
| 880,621 | 3/1908 | Bowers | 292/341.15 X |
| 1,086,365 | 2/1914 | Hendren | 292/341.15 X |
| 1,358,885 | 11/1920 | Shimocuskies | 292/341.15 X |
| 1,413,979 | 4/1922 | Freund | 292/170 |
| 1,471,061 | 10/1923 | Reineman . | |
| 2,593,573 | 4/1952 | Kulbersh | 292/169 |
| 3,095,724 | 7/1963 | Truhon | 70/146 |
| 3,318,123 | 5/1967 | Piazza | 70/447 |
| 3,773,369 | 11/1973 | Wersonick | 292/150 |
| 3,806,176 | 4/1974 | Massie | 292/150 |
| 4,073,525 | 2/1978 | Gurule | 292/346 |
| 4,159,838 | 7/1979 | Wilzig et al. | 292/150 |

*Primary Examiner*—Richard E. Moore

*Attorney, Agent, or Firm*—Fisher, Christen & Sabol

[57] ABSTRACT

A latch bolt strike lock which has a locking plate, horizontally reciprocating, located within a door latch strike plate. When actuated by a vertically reciprocating locking actuator, the locking plate engages a rectangular bolt locking recess installed into the flat side of the reciprocating latch bolt of the door lock. Thereby forceable retraction of the latch bolt from the latch bolt hole is prevented.

11 Claims, 5 Drawing Figures

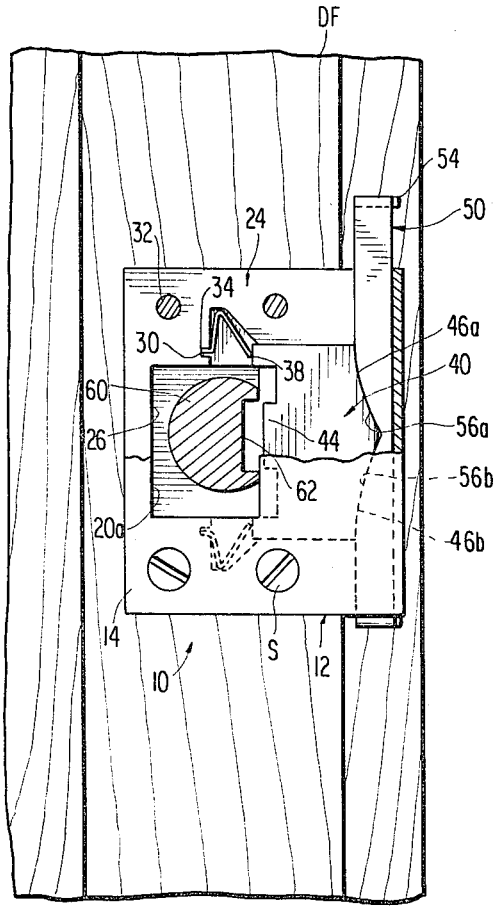
FIG. 3
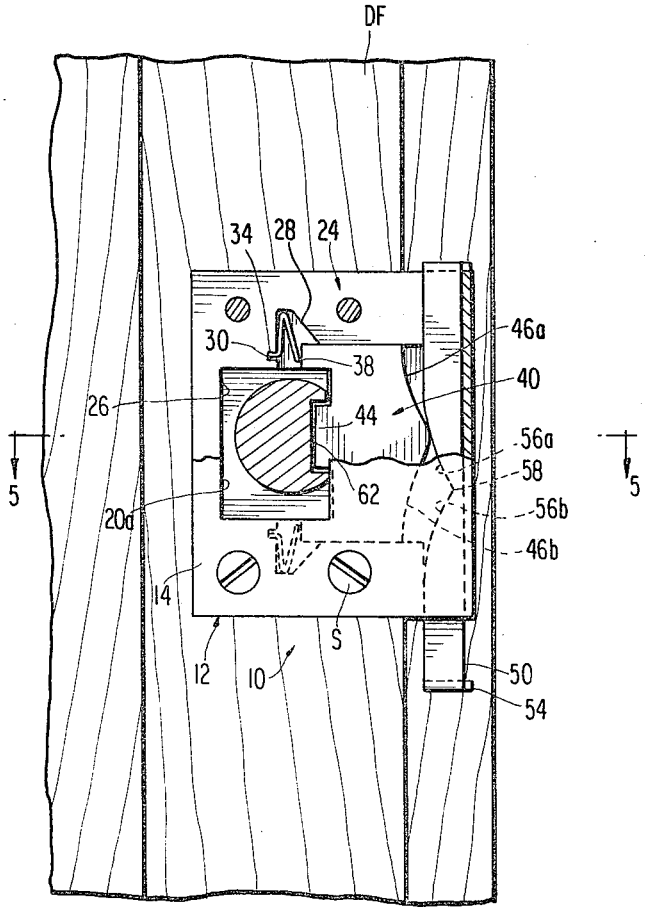
FIG. 4
FIG. 5
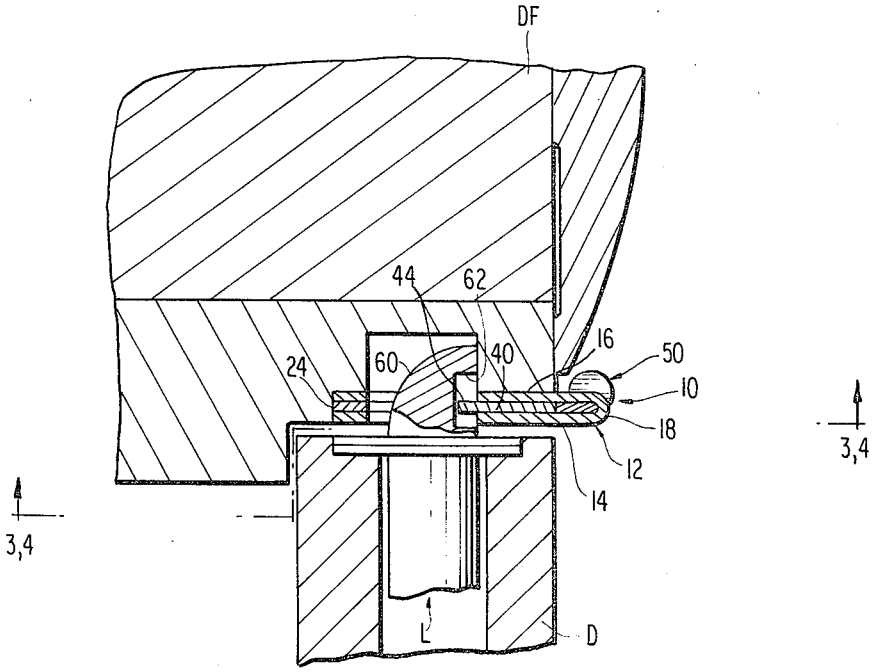

LATCH BOLT STRIKE LOCK

BACKGROUND OF THIS INVENTION

1. Field of This Invention

This invention relates to a latch bolt strike lock which secures the latch bolt of a door lock, locked or unlocked, to prevent unauthorized entry.

2. Prior Art

Most locks can be opened by means of a skelton key, so that the door knob can be turned and the latch both withdrawn from the keeper recess. Inasmuch as key-controlled knob actuated latch bolts are subject to comparatively easy jimmying, many and varied safety devices and guards have been devised and offered for use. Although many of these prior art adaptations somewhat serve the purposes for which they have been perfected and used, they, for the most part, require extra keys and are often difficult to install and are consequently expensive. There has long existed a need for a reliable, simple, economical latch bolt locking device.

U.S. Pat. No. 3,806,178 (Massie) discloses a door locking mechanisms wherein a pin is passed through a corresponding hole in the locking bolt to prevents its inadvertent withdrawal. Massie shows the locking mechanism associated with a strike plate. In both of the embodiments shown by Massie, the locking pin extends horizontally through the strike plate and passes into the door lock bolt. Massie teaches a strike plate having an opening formed to receive a latch bolt, and a latchbolt-camming portion. There are spaced strike plate ports—one extending from adjacent the latchbolt-camming portion and the other extending from adjacent the opening. The strike plate is mounted on a jamb member with a portion of the jamb lying between the parts and the opening providing the latchbolt with access to a recess in the jamb member. There is also a pin associated with the strike plate and which is sized to be removably inserted into opening means through the strike plate parts and the jamb portion and into the jamb member recess for locking a latch bolt or catch when engaged through the strike plate. The Massie system requires drilling a hole through the lock bolt when installed (i.e., the hole must be drilled in the field).

U.S. Pat. No. 1,471,061 (Reineman) discloses a door latch mechanism wherein the reciprocable lock bolt has a slot. The slot faces the outside of the door and is intended to prevent the movement of the lock bolt by a flat instrument inserted between the door and the jamb. The flat instrument engages the slot and the intended intruder cannot exert any leverage thereon to forcibly retract the lock bolt. Specifically, Reineman teaches a latch bolt having its end tapered on one side and straight on the other side. There is a parallel-sided transverse slot at the inner or wider edge of the tapered side and an inclined surface connecting one of the sides of the slot and the tapered portion of the bolt.

U.S. Pat. No. 2,593,573 (Kulbersh) discloses a door lock mechanism having internal means to prevent the withdrawal of the lock bolt. U.S. Pat. No. 3,095,724 (Truhon) also teaches a latch mechanism having internal means to prevent the withdrawal of the lock bolt.

U.S. Pat. No. 3,318,123 (Piazza) teaches a door locking mechanism wherein a relatively thin plate engages a slot in the latch bolt to prevent its retraction when the door is in a latched position. Piazza shows a locking plate associated with the door itself. The locking plate is pivotably attached to the edge of the door (between the door and frame).

U.S. Pat. No. 3,773,369 (Wersonick) teaches a door locking mechanism wherein a relatively thin plate engages a slot in the latch bolt to prevent its retraction when the door is in a latched position. Wersonick shows a locking plate associated with the door itself. The locking plate is slidably engagable with the lock bolt and can be chained to the door to prevent its loss upon removal.

U.S. Pat. No. 3,948,550 (Vigluicci et al.) teaches a door latch mechanism wherein the reciprocable lock bolt has a slot. The slot faces the outside of the door and is intended to prevent the movement of the lock bolt by a flat instrument inserted between the door and the jamb. The flat instrument engages the slot and the intended intruder cannot exert any leverage thereon to forcibly retract the lock bolt. Specifically, Vigluicci et al. discloses a latch for use with a door knob lock for contact which includes a bolt having a free end and a beveled surface thereat along its closing edge. The bolt has a slot defined by a first side wall substantially perpendicular to the axis of the bolt and formed adjacent to the edge of the door. There is a second spaced-apart wall having a length substantially smaller than the length of the first side wall formed within the bolt and within the door jamb recess, and a base surface interconnecting the walls together. The width of said slot is greater than a gap between the door and the door jamb. The intersection of the base surface with the second wall forms a notch having an acute angle. The base surface is inclined with respect to the axis of the bolt in a direction widening towards the free end. Upon insertion of a flat instrument into the slot on the base surface. The bolt is biased in a locking direction toward its free end securely into the door jamb, and its intersection with the first wall forms an acute angle.

U.S. Pat. No. 4,073,525 (Gurule) teaches a door locking mechanisms wherein a pin is passed through a corresponding hole in the locking bolt to prevent its inadvertent withdrawal. Gurule has a door lock, which includes a latch bolt spring biased for latching a door and handle means for manual articulation of the bolt against the spring bias thereof. There is a support plate adapted for attachment to the surface of the door in substantial alignment over the latch bolt. The plate includes an opening in the face thereof aligned over the bolt and a clip structure extending from the plate proximate the horizontal edge thereof conformed in the manner of a substantially semicircular hoop segment adjacent the plate and a straight segment distal thereof substantially parallel to the plate. There is a first and second bore formed respectively in the door and the latch bolt in axial alignment with the opening. There is also a pin assembly which includes a pin extending from a handle. The pin is conformed for alternate receipt in the opening and first and second bores and in the hoop segment. The handle includes a detent extending radially from the axis of the pin conformed for receipt between the straight segment and the plate when the pin is inserted in the common interior of the opening and the first and second bore. (The hole must be drilled in the field).

BROAD DESCRIPTION OF THIS INVENTION

An object of this invention is to provide a latch bolt strike lock wherein the lock bolt is retained directly in the lock bolt strike. Another object of this invention is to provide a latch bolt strike lock which composes a simple and inexpensive means of holding the latch bolt of a door lock in the extended or locked or fastened position, and preventing retraction of the latch bolt from the latch bolt hole. A further object of this invention is to provide a latch bolt strike lock which has quick actuator action locking and unlocking, and has actuator action that locks the latch bolt tightly in the latch hole and forces the door tight against the door stop. Other objects and advantages of this invention are set out herein or are obvious herefrom to one ordinarily skilled in the art.

The objects and advantages of this invention are achieved by the latch bolt strike lock of this invention.

Broadly the latch bolt strike lock of this invention involves a locking plate, horizontally reciprocating, located within a door latch strike plate, which when actuated by a vertically reciprocating locking actuator, engages a bolt locking recess installed into the interior flat side of a reciprocating latch bolt of a door lock, thereby preventing forceable retraction of the latch bolt from the latch bolt hole. Preferably the bolt locking recess is a rectangular bolt locking recess, that is, the bolt locking recess has a rectangular cross-section (when viewing the flat side of the reciprocating latch bolt). All of the sides of the blot lock recess preferably are regular parallelograms. There are no grooves or slots in the flat side of the reciprocating latch bolt. It is especially important that there are no grooves or slots located on the (exposed portion of the) flat face of the lock bolt, especially any in communication with the bolt locking recess.

This invention includes a latch bolt strike lock which includes a door jamb, the door jamb having a recessed portion, a door mounted in the door jamb, and a door lock mounted in the door, the door lock having a lock bolt. The lock bolt has a flat side, which has a bolt locking recess therein. The door lock is movable between extended and retracted positions, and engages the recessed portion of the door jamb when said door is closed and the lock bolt is in the extended position. A door striker plate is attached to the door jamb and has an opening therein corresponding to the recessed portion of the door jamb to allow entry of the lock bolt. A locking plate is attached to the striker plate so as to be reciprocal between a first position wherein the locking plate does not engage the bolt locking recess in the lock bolt and a second position wherein the locking plate engages the bolt locking recess in the lock bolt to thereby prevent undesired retraction of the lock bolt.

When the door is closed and the latch bolt of the door lock extends through the latch bolt hole of the striker plate containing the locking plate mounted in the door frames door rabbet, the rectangular bolt locking recess installed into the flat side of the reciprocating latch bolt of the door lock is engaged by a locking tab on the end of a horizontally reciprocating locking plate. The cam on the opposite end of the locking plate is activated by a tapered section of the vertically reciprocating locking lever moving in the downward direction. This moves the locking plate towards the latch bolt hole. The locking tab projects into the rectangular bolt locking recess installed into the flat side of the latch bolt and the shoulders on each side of the locking tab are pressed tight against the horizontal shoulders of the rectangular bolt locking recess in the flat side of the latch bolt. The wedging action of the tapered section of the locking actuator forces the door tight against the door stop, preventing any successful attempt to insert a tool and force the door open.

Pressing the vertically reciprocating locking actuator in an upwards direction releases the pressure of the tapered section of the locking actuator against the cam on the end of the horizontally reciprocating locking plate, and the return springs presses against the spring activating arms of the locking plate and returns it to it's neutral or unlocked position.

The latch bolt strike lock of this invention; can easily be installed with only a screwdriver; can be made entirely of heavy gauge sheet steel; has quick actuator action locking and unlocking; has actuator action which locks the latch bolt tightly in the latch hole; has actuator action which forces the door tight against the door stop; and can solidly be held in place by four screws instead of two. An important advantage of the device of this invention is that the rectangular locking recess in the flat side of the latch bolt compensates for the space variances between doors and door jambs and for the horizontal misalignment of the latch bolt and latch strike hole centers (axes thereof).

The retraction of the latch bolt by persons external to the secured space is prevented by the device of this invention so the device serves as a safety means for door locks. The latch bolt strike lock is a tamper-resistant and jimmy-proof inside guard. When the lock bolt strike lock of this invention is activated, the door cannot be opened by the use of the lock's own key, or by removal of the locking cylinder or the lock body. The locking plate can be easily disengaged from the latch when not in use by a person on the appropriate (inside) side of the door. The basic object of this invention is to retain the lock bolt directly in the lock bolt door strike—the prior art has been able to achieve such only by drilling a hole through the lock bolt at the time of installation so that a pin can be inserted.

DETAILED DESCRIPTION OF THIS INVENTION

In the drawings:

FIG. 3 is a sectional view along lines 3—3 in FIG. 5 showing the latch bolt strike lock in the unlocked position;

FIG. 4 is a sectional view along lines 4—4 in FIG. 5 showing the latch bolt strike lock in the locked position; and FIG. 5 is a sectional view along lines 5—5 in FIG. 4 showing components of the latch bolt strike lock in the locked position.

Figure 1:
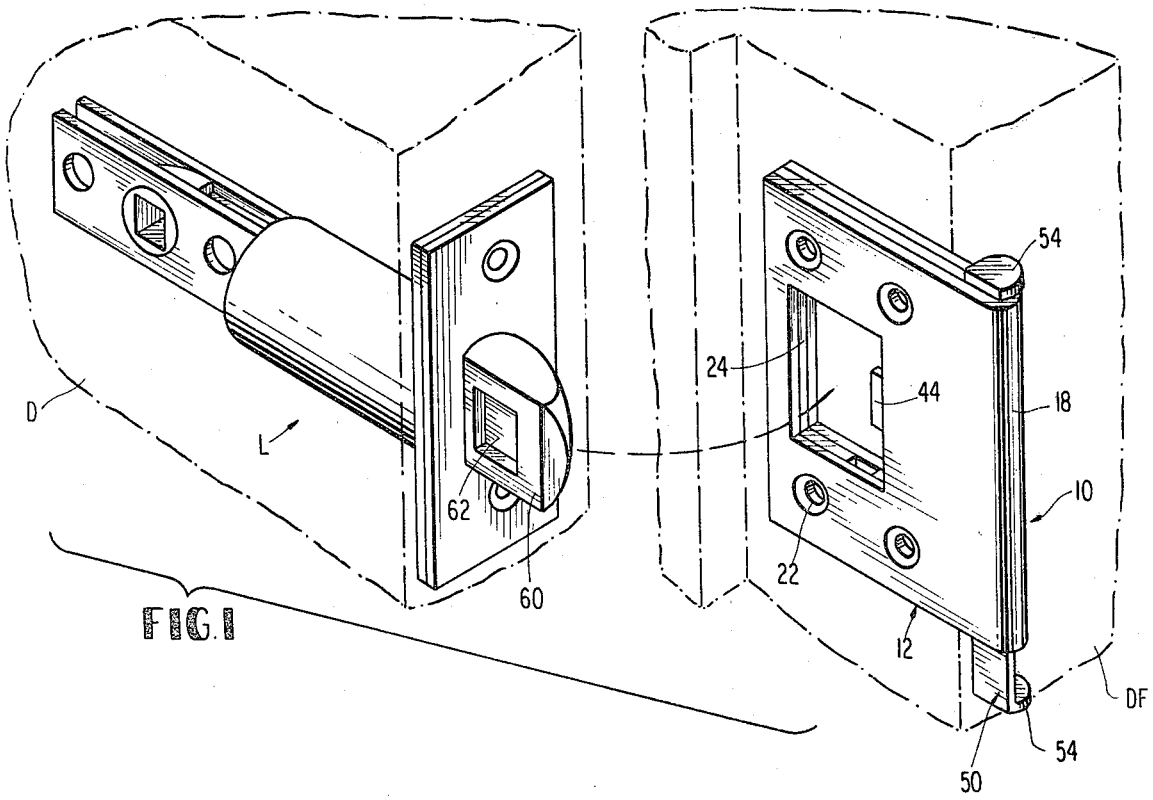
FIG. 1 is a perspective view of the latch bolt strike lock arrangement of this invention.

Locking device 10 is mounted on door jamb or frame DF by means of screws S which extend through hole 22. Locking actuator 50 is reciprocally mounted (normally vertically) in the slot formed by front and back portions 14 and 16 and at the bent portion 18 end. The upwards and downwards motion of locking actuator 50 is prevented beyond certain points by finger tabs 54 mounted on the ends of body 52. Striker locking plate 12 has a recessed portion on the edge or side facing away from bent portion 18 of locking device 10. The recessed portion is formed by wedging surfaces **56*a* and 56*b*, which come together at apex 58 that is located midway between the ends of body 52. The recessed portion is shaped like a very wide angle on the order of 145°. Wedging surfaces 56*a* and 56*b*** are slightly convex.

Spacer plate 24 is mounted in the end of the slot formed by front and back portions 14 and 16 by means of screws S which extend through holes 32 located in spacer plate. Spacer plate 24 is ⊔-shaped having latch bolt cutout 26 therein. Latch bolt cutout 26 is wider in its top portion—two rim areas being formed between its top and bottom portions. Each of the two rim areas contains a recess 28 for bent end 36 of leaf spring 34. The apex portion of each leaf spring 34 resides in a recess 30, which is located in the wall of the top portion of latch bolt cutout 26 right after the rim area. End 38 of leaf spring 34 extends into the top region of latch bolt cutaway 26.

Locking plate 40 is reciprocatingly mounted in the top portion of latch bolt cutaway 26 (in a vertical manner). Lock plate 40 has end protrusions (projections) **42*a* and 42*b*, which are in constant contact with ends 38 of leaf springs 34. (See FIGS. 3 and 4). Locking plate 40 contains locking tab 44, which fits into rectangular recess 62 of latch bolt 60. The recessed shoulders on both sides of locking tab 44 firmly press against the flat face around recess 62 (horizontal shoulders thereof) when locking plate 40 is in the engaging or locking position. This prevents unauthorized external removal of latch bolt 60 from the recess in door frame DF. The end of locking plate 40 towards bent portion 18 of striker locking plate 12 is a mirror image of the recessed side portion of locking actuator 50. The protruding portion (or cam) is formed by wedging surfaces 46*a* and 46*b*, which came together at apex 48 that is located midway the top and bottom edges of locking plate 40. Wedging surfaces 46*a* and 46*b*** are slightly concave.

In FIG. 1, door latch or door lock (universal latch) L is mounted in a hole in door D by means of two wood screws (not shown). The hole is best seen in FIG. 5. Door latch L is a conventional door latch except that it contains rectangular recess 62 in the inwardly-directed flat face of latch bolt 60 (which is normally horizontally operable). Preferably recess 62 is rectangular, but it can have other cross-sections (such as, circular, oblong, triangular, etc.). It is important though that it not be in effect a slot, that is, with a hole or holes or grooves in the rim of recess 62. This helps hold locking tab 44 in place and helps keeping the device from being jimmied with a wire.

Figure 2:
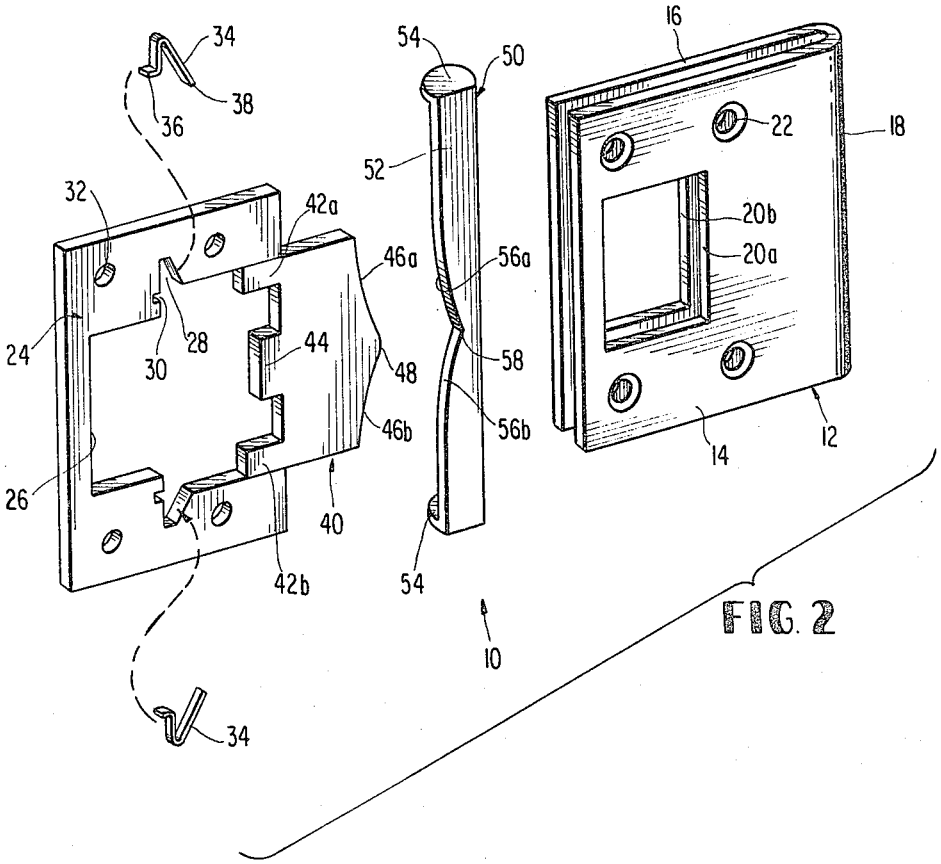
FIG. 2 is an exploded perspective view of the latch bolt strike lock arrangement of this invention.

Locking device 10 includes folded latch strike lock plate 12, which has front portion 14, back portion 16 and bent (folded) portion 18. Reference is made to FIG. 2. Rectangular apertures **20*a* and 20*b* located in front portion 14 and back portion 16**, respectively, and are coaxially aligned with each other.

Locking actuator 50 is pushed down, which forces locking plate 40 against latch bolt 60. Locking tab 44 is inserted into rectangular recess 62 in the flat side of latch bolt 60—this prevents the withdrawal of the latch bolt 60 from the latch bolt hole. The shoulders on each side of locking tab 40 are pressed against the horizontal shoulders of recess 62 in the flat side of latch bolt 60. Vertically reciprocating locking actuator 50 is then in the full downward postiion, with the tapered cam activating wedge tight against the cam on locking plate 40. This wedging action forces door L tight against to door stop of door frame DL, preventing the insertion of a tool to force door L open.

Pressing or lifting the vertically reciprocating locking actuator 50 upwards, releases the pressure of the tapered section against the cam. Return springs 34 press against the spring activating arms **42*a* and 42*b* of locking plate 40** and return it to a neutral or unlocked position.

This invention can be used with any type of lock unit which has been provided with the required recess in the latch bolt.

The drawings illustrate the preferred embodiment of this invention.

While certain specific forms of this invention have been shown and described, in preferred form, it is understood that various changes and modifications may be made as deemed desirable within the scope of the appended claims.

What is claimed is:

1. A latch bolt strike lock comprised of a door jamb, said door jamb having a recessed portion, a door lock mounted in a door, said door lock having a lock bolt, said lock bolt having a flat face, having a bolt locking recess in said flat face, being movable between extended and retracted positions, and engaging said recessed portion of said door jamb when said door is closed and said lock bolt is in the extended position, there not being any holes, openings or grooves in the rim of said recess, a door striker plate attached to said door jamb and having an opening therein corresponding to said recessed portion of said door jamb to allow entry of said lock bolt, and a locking plate attached to or mounted in or on said striker plate so as to be reciprocal between a first position wherein said locking plate does not engage said bolt locking recess in said lock bolt and a second position wherein said locking plate engages said bolt locking recess in said lock bolt to thereby prevent undesired retraction of said lock bolt, said door striker plate being ⊔-shaped, and said locking plate being slidably mounted within a ⊔-shaped spacer plate, said ⊔-shaped spacer plate being mounted within said striker plate.

2. The latch bolt strike lock as claimed in claim 1 wherein the end of said locking plate facing away from said ⊔-shaped spacer plate is inclined from each edge toward the center, forming a cam, and means is present for moving said locking plate between said two positions, said means being a vertically reciprocating elongated plate which has a recessed section in the side thereof which faces said end of said locking plate facing away from said ⊔-shaped spacer plate, said recessed section in the side thereof being a mirror image of said inclined end of said locking plate, and which is movably mounted within said door striker plate at a right angle to said locking plate so as to movably engage said inclined end of said locking plate, movement of said elongated plate means causing movement of said locking plate, either to or from engagement in said recessed portion in said lock bolt, by the force applied to said cam of said locking plate.

3. The latch bolt strike lock as claimed in claim 2 wherein said engaging and disengaging end of said locking plate is a protrusion flanked by two shoulder portions, when engaged, said protrusion extends into said recessed portion of said lock bolt and said two shoulders press tight against said flat side of said lock around said recessed portion.

4. The latch bolt strike lock as claimed in claim 2 wherein at least one spring is mounted in said ⊔-shaped spacer plate so as to press against said locking plate when said locking plate is in said engaged postiion when said elongated plate means is moved into disengagement position.

5. The latch bolt strike lock as claimed in claim 4 wherein said locking plate has at least one end protrusions which contact said at least one spring.

6. The latch bolt strike lock as claimed in claim 1 wherein said locking plate is horizontally reciprocal between said first position and said second position, and said horizontally reciprocal locking plate is actuated by a vertically reciprocal locking actuator attached to or mounted in or on said striker plate.

7. The latch bolt strike lock as claimed in claim 6 wherein said vertically reciprocal locking actuator has a tapered section which actuates said horizontally reciprocating locking plate.

8. The latch bolt strike lock as claimed in claim 7 wherein the wedging action of said tapered section of said vertically reciprocal locking actuator forces the door tight against the door stop, thereby preventing any successful insertion of a tool and forcing open of the door.

9. The latch bolt strike lock as claimed in claim 1 wherein said reciprocal locking plate is actuated by a reciprocal locking actuator attached to or mounted in or on said striker plate, said reciprocal locking actuator being located in the same plane in which said reciprocal locking plate is located, and said reciprocal locking actuator being reciprocal in an axis which is at a right angle to the axis in on which said reciprocal locking plate reciprocates.

10. In combination, a door lock containing a door lock, which is for mounting in a door, said lock bolt having a flat side, having a bolt locking recess in said flat side, being movable between extended and retracted positions, and being capable of engaging the recessed portion of a door jamb when the door is closed and said lock bolt is in the extended position, a door striker plate, for attachment to a door jamb, said striker plate having an opening therein corresponding to the recessed portion of the door jamb to allow entry of said lock bolt, and a locking plate attached to said striker plate so as to be reciprocal between a first position wherein said locking plate does not engage said bolt locking recess in said lock bolt and a second position wherein said locking plate engages said bolt locking recess in said lock bolt to thereby prevent undesired retraction of said lock bolt, said locking plate being horizontally reciprocal between said first position and said second position, and said horizontally reciprocal locking plate being actuated by a vertically reciprocal locking actuator attached to or mounted in or on said striker plate.

11. In combination, a door striker plate, for attachment to a door jamb having a recessed portion, said door striker plate having an opening therein corresponding to the recessed portion of said door jamb, when said door striker plate is attached to said door jamb, to allow entry of the lock bolt of a door lock mounted in a door, and a locking plate attached to or mounted in or on said striker plate so as to be reciprocal between a first position wherein said locking plate does not engage said bolt locking recess in said lock bolt to thereby prevent undesired retraction of said lock bolt, said locking plate being horizontally reciprocal between said first position and said second position, and said horizontally reciprocal locking plate being actuated by a vertically reciprocal locking actuator attached to or mounted in or on said striker plate.

* * * * *